US006874442B1

(12) United States Patent
McDonough

(10) Patent No.: US 6,874,442 B1
(45) Date of Patent: Apr. 5, 2005

(54) KAYAK OR CANOE INCLUDING A COAMING HAVING AT LEAST ONE SUPPORT BRIDGE

(75) Inventor: Robert McDonough, Greensboro, NC (US)

(73) Assignee: Confluence Holdings Corp., Trinity, NC (US)

( * ) Notice: Subject to any disclaimer, the term of this patent is extended or adjusted under 35 U.S.C. 154(b) by 0 days.

(21) Appl. No.: 10/635,216

(22) Filed: Aug. 6, 2003

(51) Int. Cl.[7] ..... B63B 35/00
(52) U.S. Cl. ..... 114/347
(58) Field of Search ..... 114/343, 345, 114/347, 352, 353, 363, 364

(56) References Cited

U.S. PATENT DOCUMENTS

| | | | | | |
|---|---|---|---|---|---|
| 1,649,311 | A | * | 11/1927 | Kaechele et al. | 114/364 |
| 2,299,178 | A | * | 10/1942 | Lambert | 114/363 |
| 2,671,231 | A | | 3/1954 | Massicotte | 9/1 |
| 3,233,257 | A | | 2/1966 | Biehl | 9/6 |
| 3,367,349 | A | | 2/1968 | O'Link | 135/6 |
| 4,085,473 | A | | 4/1978 | Franklin | 9/1.7 |
| 4,167,050 | A | * | 9/1979 | Arcouette | 114/343 |
| 4,727,821 | A | * | 3/1988 | Masters | 114/347 |
| 4,903,629 | A | | 2/1990 | Maudlin et al. | 114/361 |
| 4,966,092 | A | | 10/1990 | Illingworth | 114/356 |
| 5,076,194 | A | * | 12/1991 | Curtis et al. | 114/347 |
| 5,094,607 | A | * | 3/1992 | Masters | 114/347 |
| 5,331,915 | A | | 7/1994 | Snyder | 114/347 |
| 5,343,824 | A | | 9/1994 | Floyd | 114/361 |
| 5,460,551 | A | * | 10/1995 | Beres | 114/347 |
| 5,501,169 | A | | 3/1996 | Denker | 114/364 |
| 5,579,715 | A | | 12/1996 | Harrell | 114/361 |
| 6,105,531 | A | | 8/2000 | Knight | 114/347 |
| 6,443,089 | B1 | * | 9/2002 | Goucher et al. | 114/347 |

OTHER PUBLICATIONS

Research Studies Press Ltd.; article entitled Rotational Moulding of Plastics by R.J. Crawford; undated; possible prior art.

Description of work done by Robson Kayaks, included in Oct. 18, 2004 Amendment.

* cited by examiner

*Primary Examiner*—Lars A. Olson
(74) *Attorney, Agent, or Firm*—MacCord Mason PLLC

(57) ABSTRACT

An improved thermoplastic kayak or canoe including a thermoplastic hull having an opening and a coaming integral with the hull and bordering the opening and including an outer and inner walls, the inner wall spaced apart from the outer wall, and at least one support bridge extending between the inner wall to the outer wall of the coaming.

21 Claims, 10 Drawing Sheets

KAYAK OR CANOE INCLUDING A COAMING HAVING AT LEAST ONE SUPPORT BRIDGE

BACKGROUND OF THE INVENTION

The present invention relates generally to an improved kayak or canoe, and more particularly, to an improved kayak or canoe hull including a coaming having at least one support bridge.

Canoes and kayaks may include a hull that may be rotary molded from polyethylene or other suitable thermoplastic materials. Rotational molding is explained in detail in ROTATIONAL MOULDING OF PLASTICS (R. J. CRAWFORD, ed., Research Studies Press, Ltd., $2^{nd}$ ed. 1996). The hull of such a kayak or canoe usually includes a cockpit in which a paddler sits. The canoe or kayak may also include a coaming at least partially bordering the cockpit and integral with the kayak or canoe's hull. The coaming adds structural support to the watercraft around the opening of the cockpit and may also provide a groove into which a skirt that encircles the paddler can be placed if needed to prevent water from entering the opening of the canoe or kayak and collecting inside the kayak or canoe's hull.

Attached to the coaming may be a brace against which a paddler places her knees, for example. Knee braces of this sort are seen in, for example, U.S. Pat. No. 6,105,531 to Knight, the entire disclosure of which is incorporated herein by reference. Knee braces allow the paddler to maneuver and control the kayak or canoe by shifting her weight to apply force to the kayak or canoe. Thus, because the knee brace is attached to the coaming, the design of the coaming has a substantial effect on the performance of the kayak or canoe.

Kayaks or canoes with larger-openings in a cockpit for multiple paddlers may have a coaming or gunwale surrounding the large opening. A canoe gunwale is the upper edge or side of the canoe. In this case stiffness in the coaming or gunwale is desired to increase overall structural integrity of the kayak or canoe, increasing the kayak or canoe's resistance to collapse. Increased resistance to collapse increases the cost-effectiveness of shipping kayaks or canoes. Thus, increased stiffness of the coaming surrounding the opening in the hull of the kayak or canoe leads-to better performance and maneuverability, and increases overall structural integrity regarding collapsibility, which reduces the product cost. In some canoes and kayaks, the seat or other device is attached to the edge of the hull, such as at the coaming or gunwale. Stresses from them can distort the hull, at least momentarily, but undesirably.

Another factor affecting the performance of a personal watercraft such as a kayak or canoe is the overall weight of the watercraft. Lower weight kayaks and canoes can obtain increased maneuverability and performance. Small increases in maneuverability and performance are critical for paddlers encountering especially treacherous waters or competing in kayak sports, for example. So while increasing the rigidity of the rim surrounding the opening in the hull of the watercraft my lead to improved performance, such an improvement in structural stiffness may be offset by an increased overall weight of the kayak or canoe if the improvement is accomplished by adding material to the coaming.

Thus, what is needed is a kayak or canoe including an improved coaming that is lighter and obtains the same stiffness as conventional cockpit coamings. A kayak or canoe with increased coaming stiffness and maintained overall weight is also needed.

SUMMARY OF THE INVENTION

The present invention is directed to an improved thermoplastic kayak or canoe comprising a thermoplastic hull having an opening, a coaming integral with the hull and at least partially bordering the opening and having outer and inner walls, the inner wall spaced apart from the outer wall, and at least one support bridge extending between the inner wall to the outer wall of the coaming.

In the preferred embodiment of the invention, the coaming includes a lip extending outwardly from the opening, providing a groove along the outer wall of the coaming for attaching a skirt to the coaming. The support bridge may contact the outer wall of the coaming.

The kayak or canoe may include a projection along the inner wall of the coamimg extending inwardly into the hull opening for attaching a knee brace to the projection and/or a plurality of holes in the projection for selectively adjusting the location of the knee brace. One or more support bridges may be adjacent the projection in the coaming.

In the preferred embodiment of the invention, the kayak or canoe hull opening provides access to a paddler's cockpit in the kayak. The canoe and/or kayak may include a hatch opening and/or an inspection port. The kayak or canoe may further include a knee brace inside the cockpit opening and/or a seat attached to the coaming, and/or a tip or bumper attached to the thermoplastic hull.

In the preferred embodiment of the invention, the kayak or canoe includes an additional support bridge in the coaming, which may be spaced from about 1 to 12 inches from the first support bridge. The inner wall of the coaming may be spaced from between about ¼ to about ¾ inches apart from the outer wall.

The present invention is also directed to an improved kayak or canoe hull comprising a hull bottom below a hull opening, and an integral coaming at least partially bordering the hull opening including an outer wall and an inner wall, the inner wall spaced apart from the outer wall, and at least one support bridge extending between the inner wall and the outer wall of the coaming.

The hull of a kayak typically includes a lip extending outwardly from the opening providing a groove along the outer wall of the coaming for attaching a skirt to the coaming. The support bridge typically contacts the outer wall of the coaming. The hull may include a projection along the inner wall of the coaming extending inwardly into the hull opening for attaching a knee brace to the projection and/or a plurality of holes in the projection for selectively adjusting the location of the knee brace. A support bridge may be adjacent the projection.

The present invention is also directed to a method of producing a thermoplastic kayak or canoe hull having a coaming including at least one support bridge comprising: providing a mold in the shape of the outer surface of the kayak or canoe hull, the mold including an inward projection for forming a support bridge in the coaming at least partially bordering an opening in the kayak or canoe hull; placing a predetermined charge of a plastic powder inside the mold; placing the mold in a heated oven; rotating the mold; cooling the mold; opening the mold; and removing the thermoplastic kayak or canoe hull including the coaming having at least one support bridge from the mold.

DESCRIPTION OF THE PREFERRED EMBODIMENTS

Figure 1:
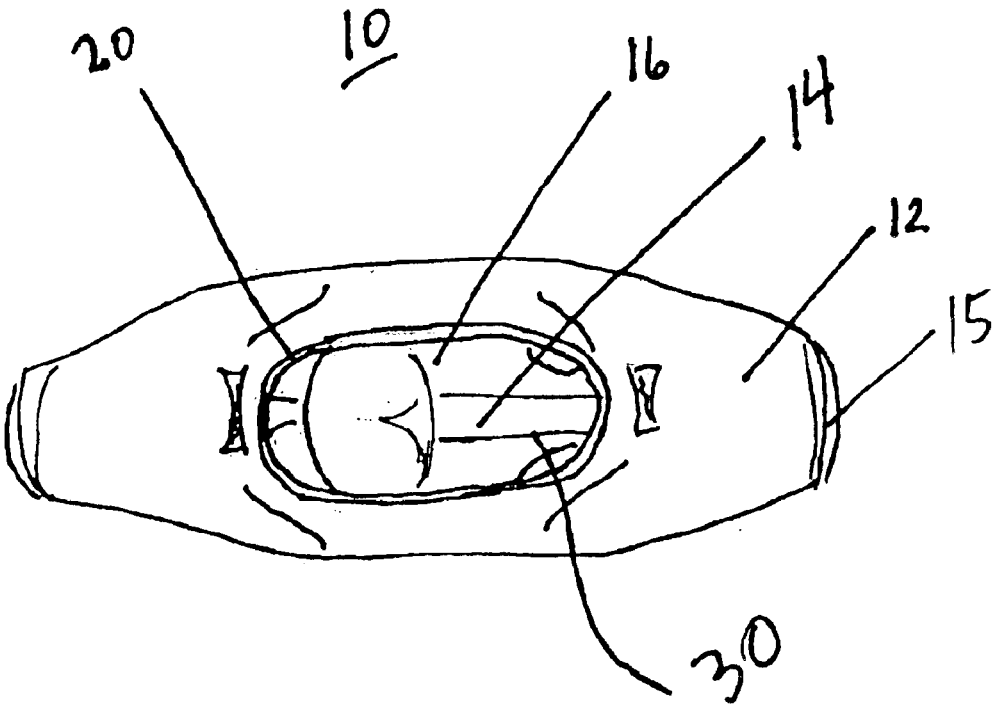
FIG. 1 is a top view of an improved kayak including a coaming having at least one support bridge.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, an improved kayak, generally designated 10, is shown constructed according to the present invention. In the preferred embodiment of the present invention, the improved kayak or canoe includes a thermoplastic hull 12 having a bottom 14 and an opening 16 in the hull above the bottom. The hull opening provides access to a paddler cockpit 30 in the kayak 10. FIG. 1 also shows a bumper 15 or tip on the end of the kayak.

Figure 2:
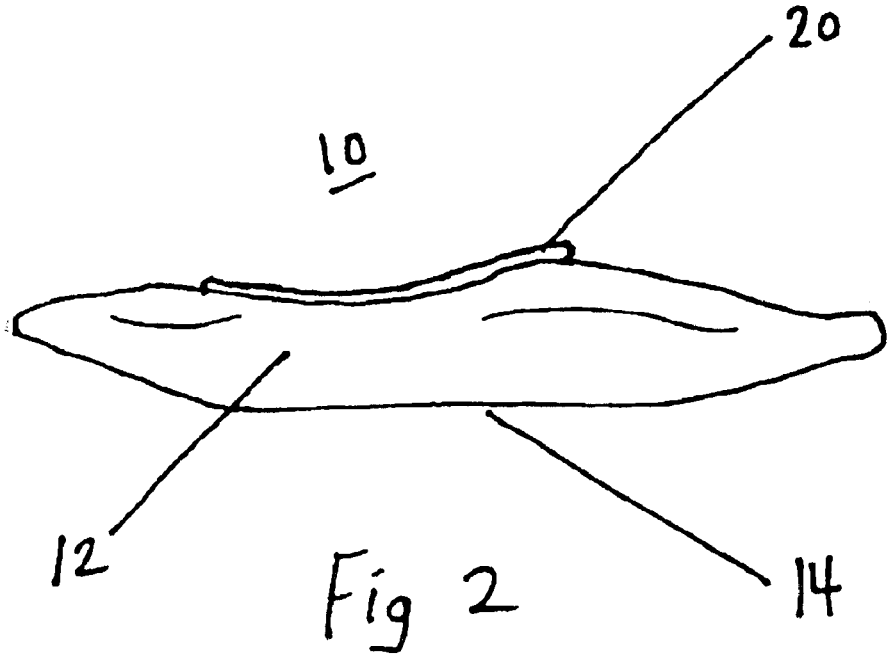
FIG. 2 is a side view of a improved kayak including a coaming 5 having at least one support bridge.

FIG. 2 is a side view of an improved kayak 10 showing the kayak or canoe hull 12 including the bottom 14.

Figure 3:
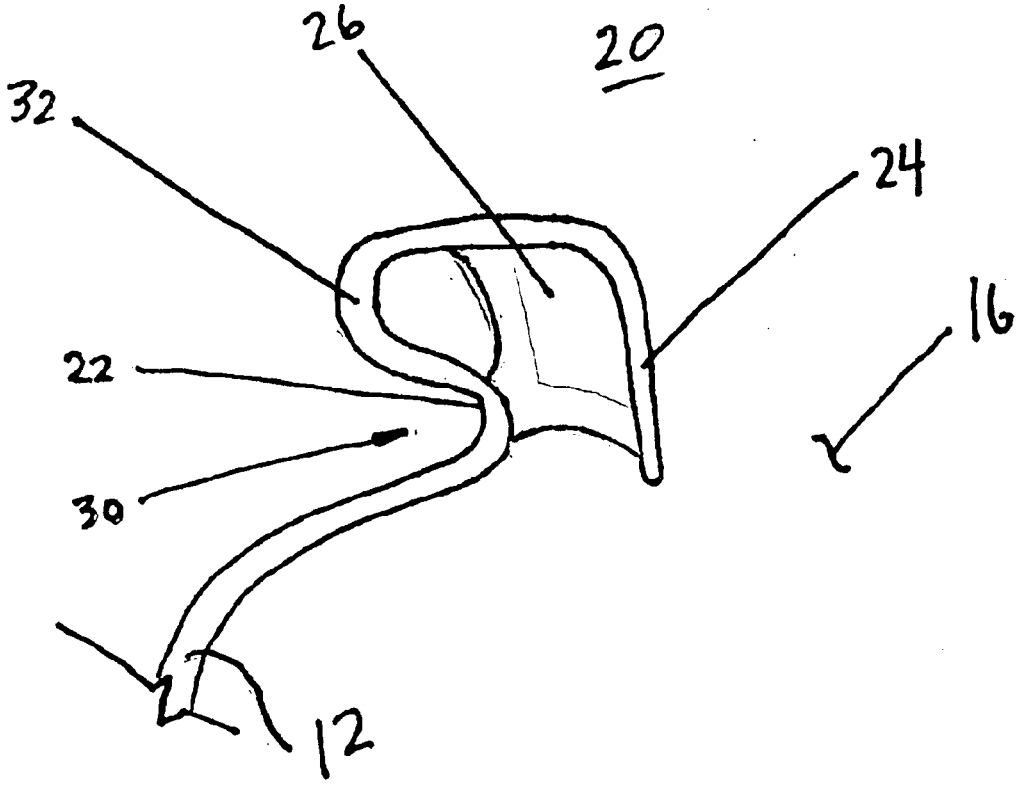
FIG. 3 is a cross-sectional view of an improved coaming for a kayak or canoe having a support bridge.

FIG. 3 is a cross-sectional view of the integral coaming 20 at least partially bordering the opening 16 in the kayak hull, showing an outer 22 and inner walls 24 of the integral coaming 20. As shown, the outer wall 22 extends downward to form the hull 12, within which the coaming 20 is integral. In the preferred embodiment of the invention, the inner wall 24 is spaced apart from the outer wall 22 from about ¼ inches to about ¾ inches at their closest. In a rotomolded boat, the sides are bridged by a "kiss-off" as explained in the Crawford text, pages 146–147, that is molded into the kayak or canoe coaming integral with the hull. Also shown in FIG. 3 is a support bridge 26 extending from the inner 24 to outer wall 22 of the coaming 20 and a lip 32 extending outwardly from the opening 16 in the kayak or canoe. While the preferred embodiment of the invention includes a lip protruding outwardly, the invention can be practiced with the lip extending inwardly, or the coaming 20 may not include a distinct lip, especially in applications to canoes. The lip 32 joins the inner 24 and outer 22 walls and provides a groove 30 along the outer wall 22 for attaching a skirt to the to the coaming. The skirt (not shown) encircles a paddler sitting in the opening 16 of the kayak or canoe and prevents water from entering the opening 16 during paddling.

Figure 4:
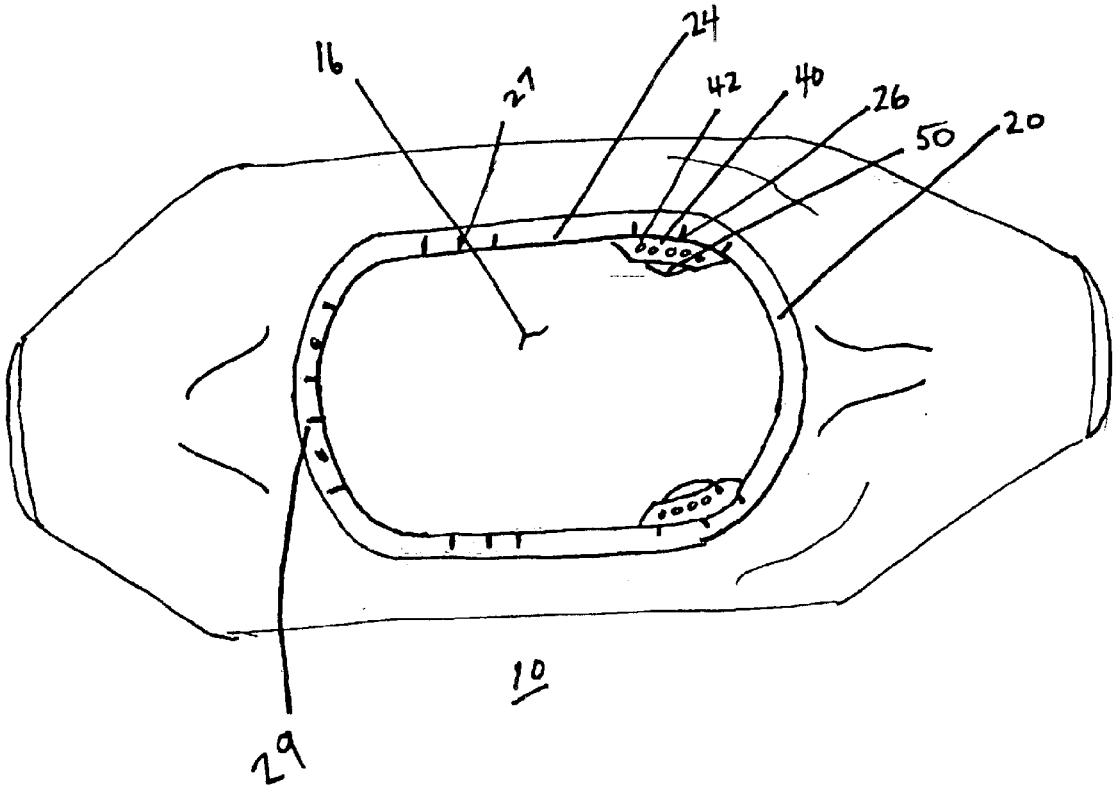
FIG. 4 is an enlarged top view of an improved kayak including a coaming having at least one support bridge.

FIG. 4 is an enlarged top view of a kayak or canoe showing a projection 40 along the inner wall 24 of the coaming 20 for attaching a knee brace 50. The projection 40 extends inwardly into the hull opening 16 and may include a plurality of holes 42 for selectively adjusting the location of the knee support 50. Other mounts for knee braces may be substituted. A support bridges 26 may be located adjacent the knee projection 40 in the coaming 20 to provide stiffness in the coaming 20 in the area surrounding the projection 40 that extends from the coaming 20. Stiffness is desired in this area because a paddler applies force to the can kayak knee brace 50 to maneuver and control the kayak 10 during paddling. Additional stiffness provided by the bridges 26 provides better performance without adding a significant amount of weight. FIG. 4 also shows bridges 27 and 29 at the sides and rear, respectively, where a kayak seat may typically be hung. These bridges add rigidity to counteract distortions that may result from weight shifting in the seat.

Figure 5:
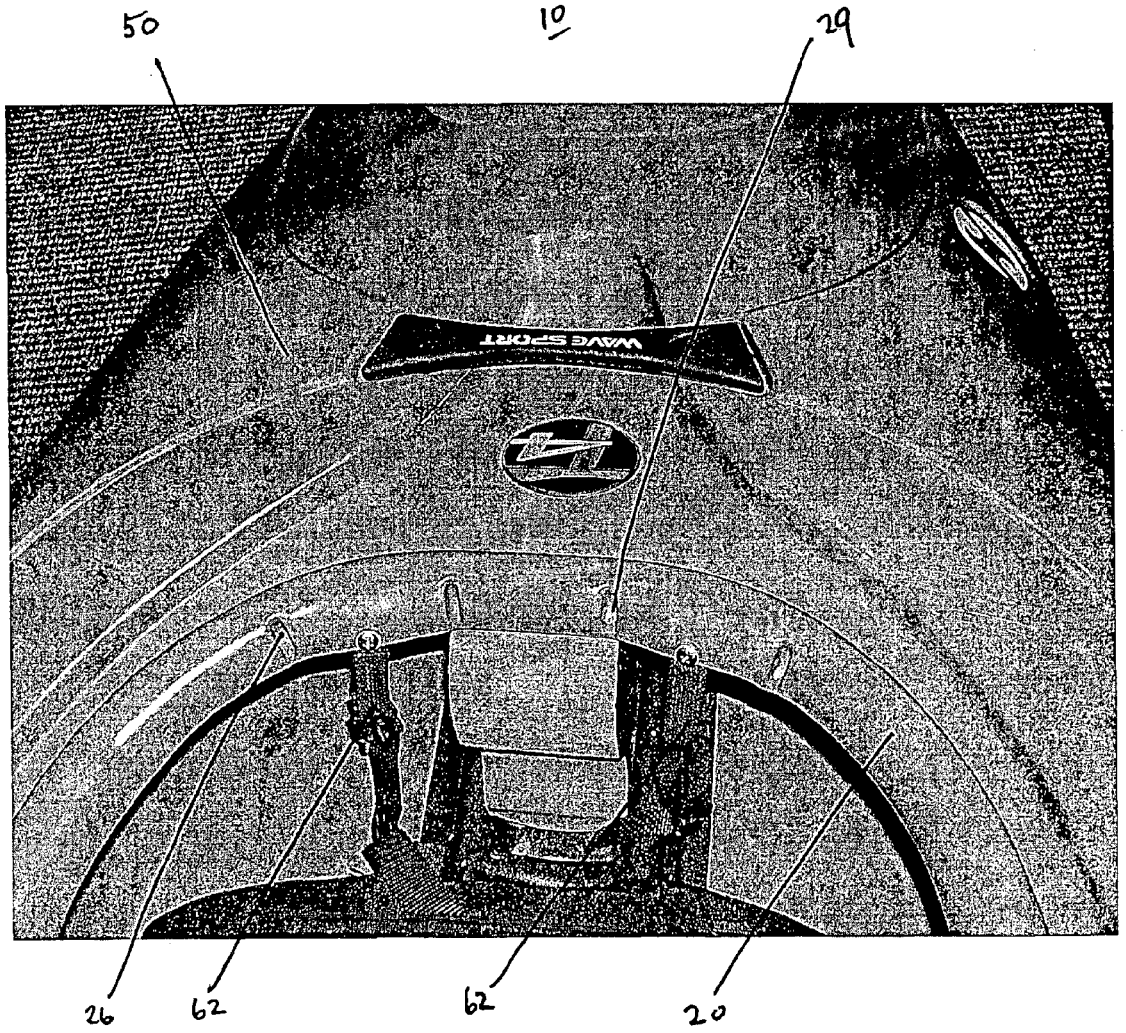
FIG. 5 is an enlarged perspective view of a kayak including a hull with an integral coaming.

FIG. 5 is an enlarged view of an improved kayak including a thermoplastic hull 12 with an integral coaming 20. The coaming 20 includes a plurality of support bridges 26 in the coaming 20 surrounding rear seat support straps 62. The kayak seat support straps 62 on one end may be attached to the coaming 20 and on the other to the kayak seat (shown in FIG. 6). Support bridges 26 are used here because a paddler in the kayak or canoe sits in the seat and so applies force to the coaming 20.

Figure 6:
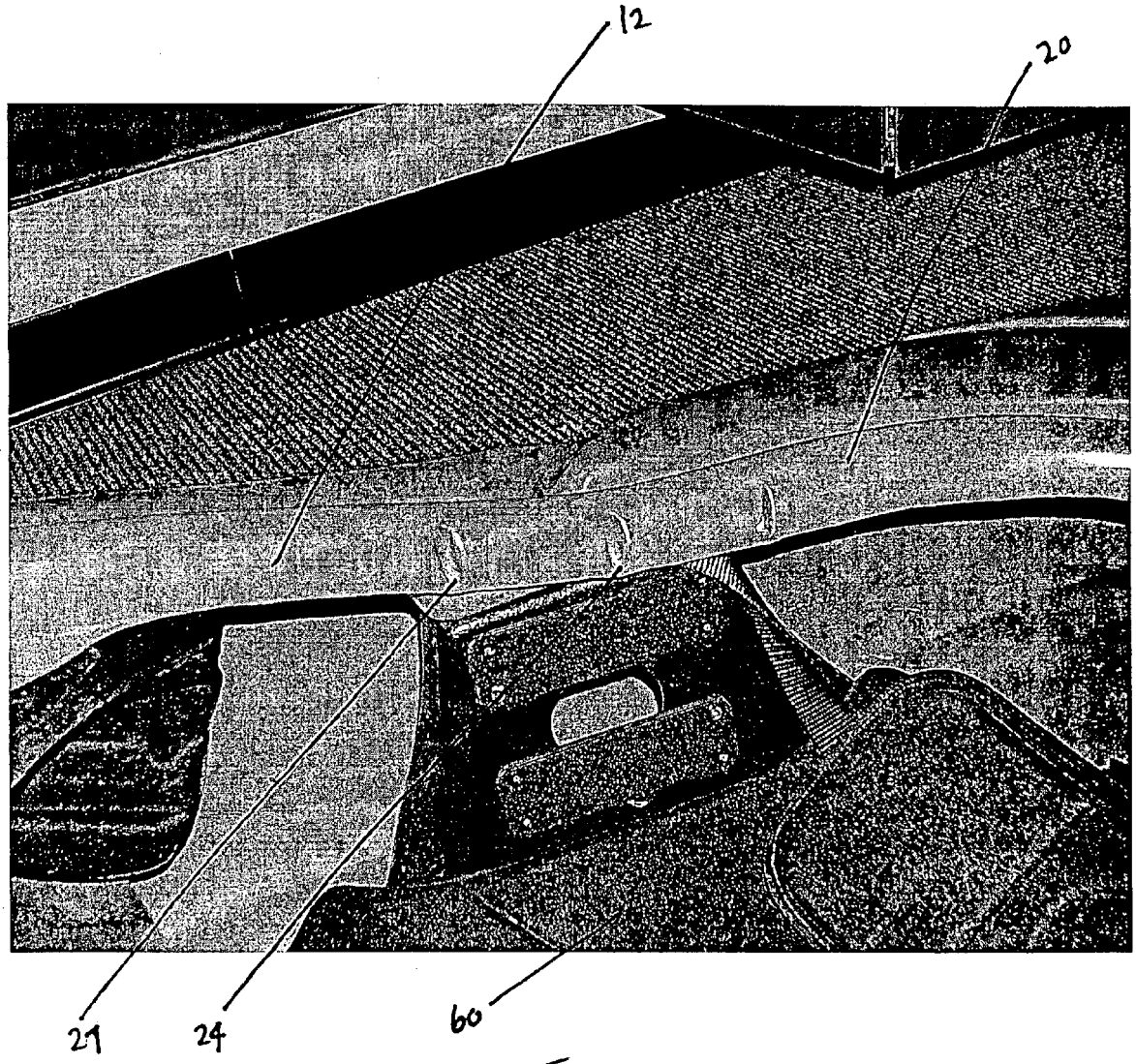
FIG. 6 is an enlarged perspective view of a kayak hull showing a kayak or canoe seat attached to the kayak or canoe hull and a plurality of support bridges adjacent the kayak or canoe seat.

FIG. 6 is an enlarged perspective view of a kayak or canoe hull 12 showing a kayak seat 60 attached to the kayak or canoe hull and a plurality of support bridges 27 adjacent the kayak or canoe seat 60. The support bridges 27 are located in the coaming lateral the kayak seat 60. The seat 60 may be attached to the thermoplastic hull 12 outside of the coaming 20 lateral of the seat 60. Support bridges 26 provide stiffness in the coaming near the lateral seat attachment and enhance performance and durability of the kayak.

Figure 7:
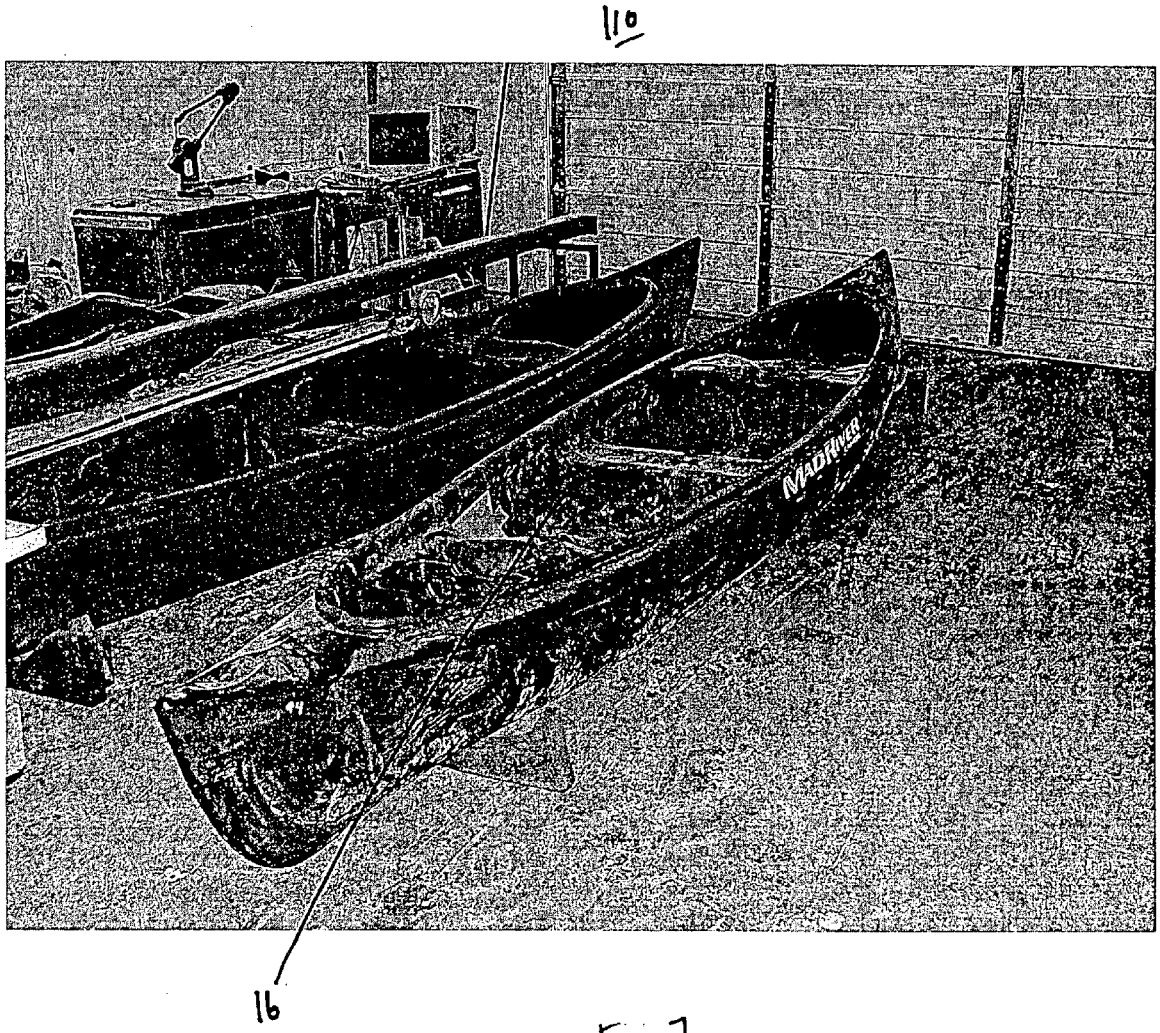
FIG. 7 is a perspective view of an improved canoe showing a kayak or canoe hull having an integral coaming.
Figure 8:
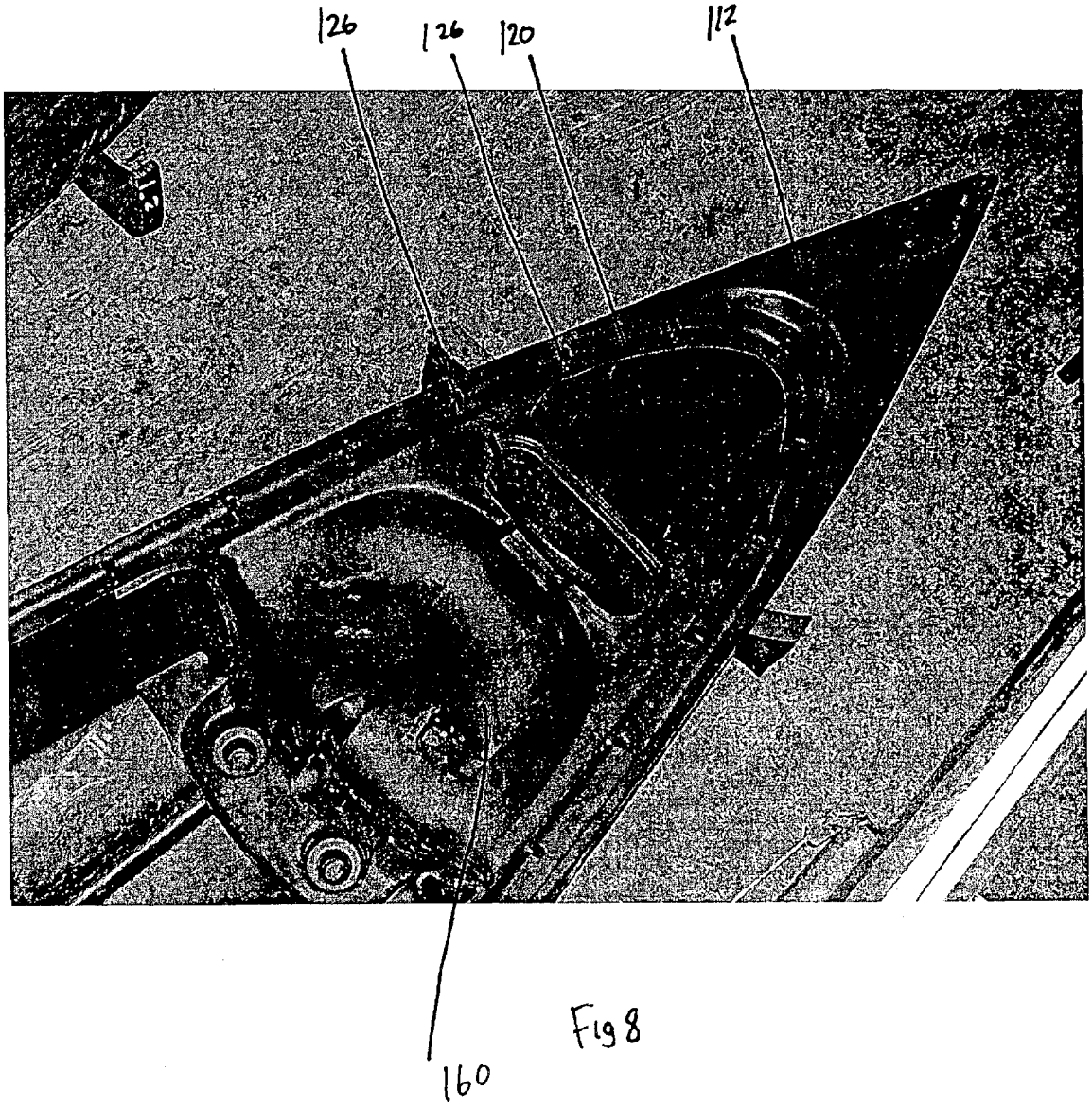
FIG. 8 is an enlarged top view of a canoe showing a canoe hull having an integral coaming.

FIG. 7 is a perspective view of an improved canoe 110 and FIG. 8 is an enlarged top view of a canoe showing a canoe hull 112 having an integral coaming 120. In the preferred embodiment of the invention, the canoe hull 112 includes a plurality of support bridges 126 spaced from between about 6 to about 8 inches apart along the coaming 120 of the canoe 110, although more or fewer support bridges may be used as required to obtain a desired structural rigidity. Likewise, the support bridges can be grouped together at high stress areas as desired. The support bridges 126 in the coaming 120 reinforce the large opening 116 in the canoe. This provides structural support and increases the rigidity of canoe 110 without adding a significant weight. As shown in FIG. 8, a seat 160 can be integrally included with the canoe 110.

Figure 9:
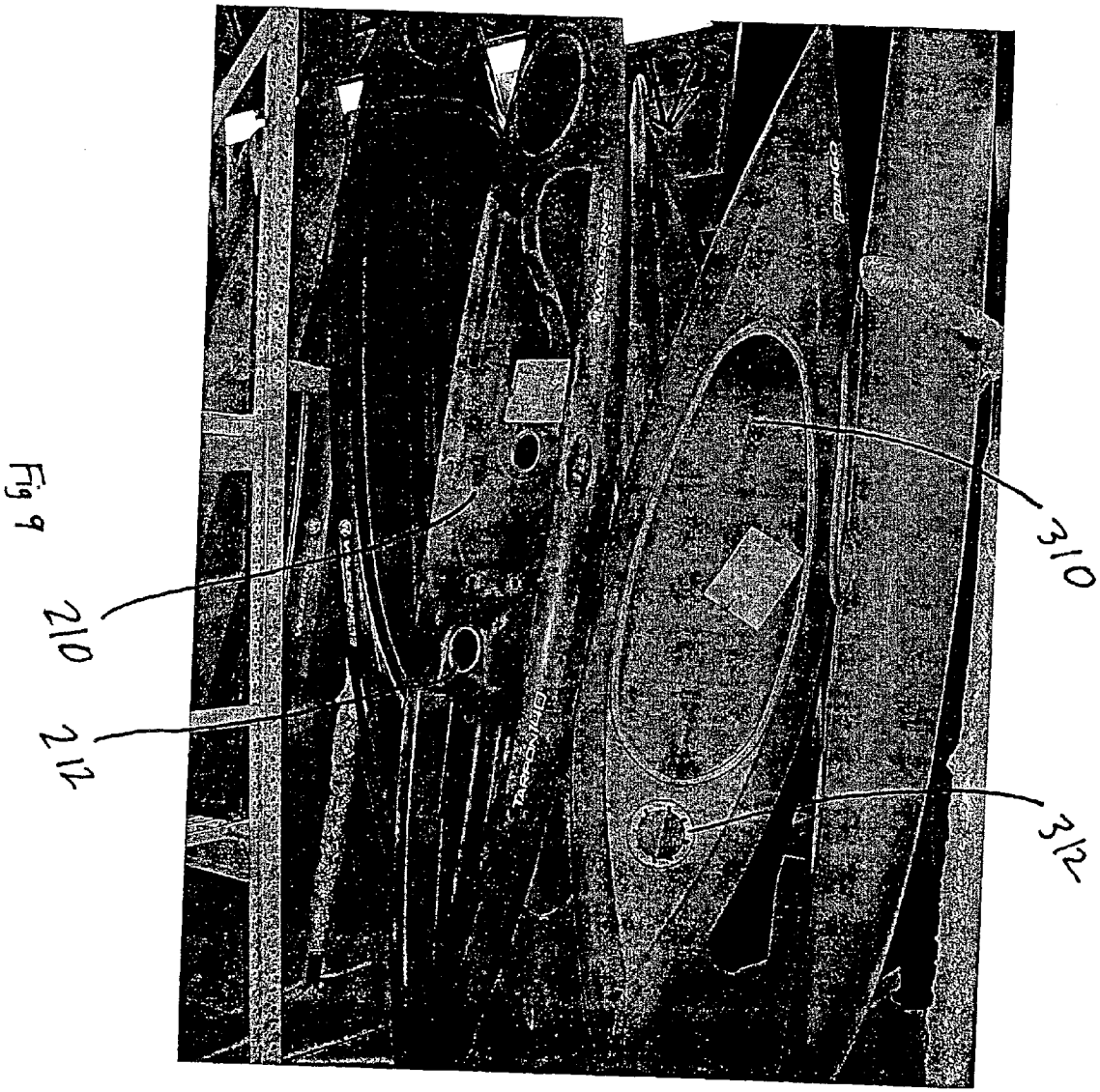
FIG. 9 is a top view of a sit-on-top kayak and a canoe hull, each including an integral hatch opening with support bridges.
Figure 10:
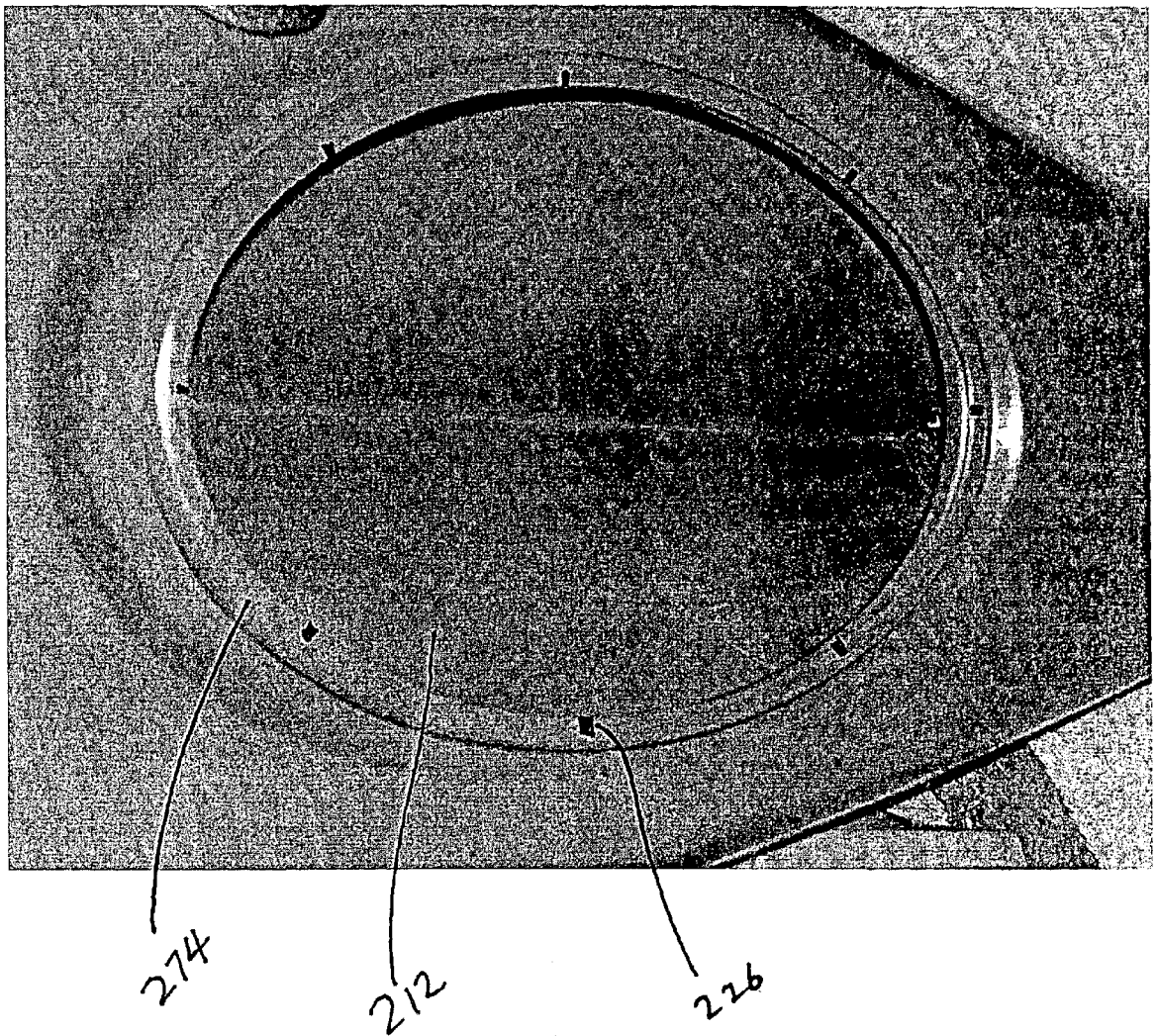
FIG. 10 is an enlarged top view of a kayak or canoe hull including an integral hatch opening with support bridges.

FIG. 9 is a top view of a sit-on-top kayak 210 and a sit-in kayak 310, each including an integral hatch opening 212, 312. The rims of these hatch openings are provided with coamings with support bridges as discussed above. FIG. 10 is an enlarged view of an integral hatch opening or inspection port 212 showing the support bridges 226 in the coaming 274 of the hatch openings.

Figure 11:
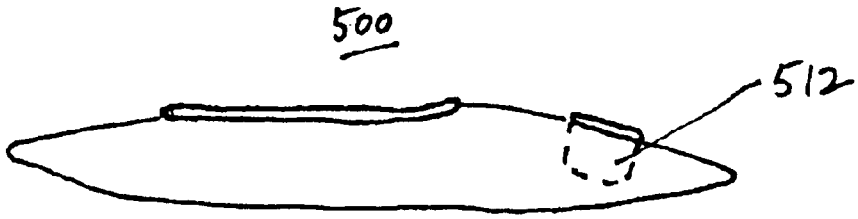
FIG. 11 is a side view of a kayak including a hull with an integral coaming including support bridges bordering an opening to a compartment.

FIGS. 10 and 11 are top and side views, respectively, of a kayak showing an opening that does not expose the inside of the kayak hull. The opening may provide access to a storage compartment, a livewell, or any others types of compartments desirable on a kayak. A coaming including a support bridge surrounds the opening in the hull of the kayak. A canoe can include such a storage compartment as well.

FIG. 11 is a side view of a kayak 500 including a hull with an integral coaming including support bridges (shown in FIG. 12) bordering an opening to a compartment. The compartment may be used for storage or as a livewell or baitwell or for any other desirable purpose. The opening shown does not expose the interior of the hull of the kayak 500, although the interior of the hull may be partially or completely exposed through the opening, as desired.

Figure 12:
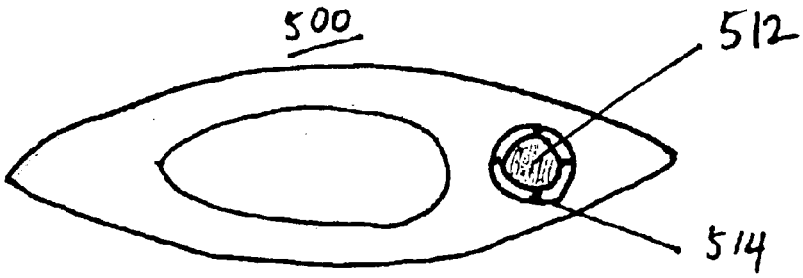
FIG. 12 is a top view of the kayak of FIG. 11.

FIG. 12 is a top view of the kayak 500 of FIG. 11 showing a support bridge in the coaming bordering the opening.

Figure 13:
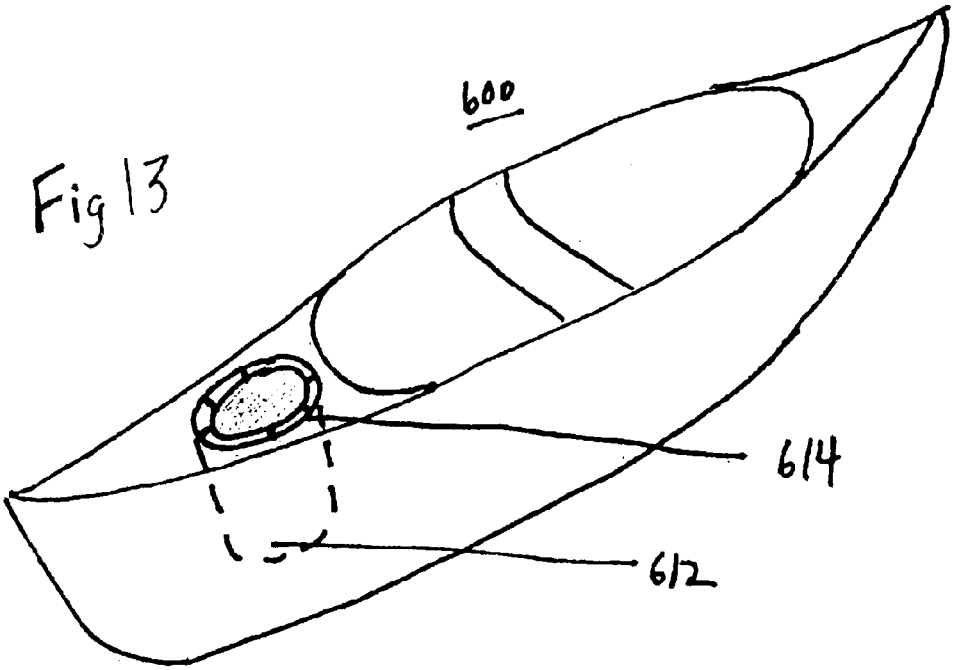
FIG. 13 is a perspective view of a canoe including a hull with an integral coaming including support bridges bordering an opening to a compartment.

FIG. 13 is a perspective view of a canoe 600 including a hull with an integral coaming including support bridges 614 bordering an opening to a compartment in the canoe. The compartment may be used for storage or as a livewell or baitwell or for any other desirable purpose. The opening shown does not expose the interior of the hull of the canoe 600, although the interior of the hull may be partially or completely exposed through the opening, as desired.

The kayak or canoe hull may be formed by first providing a mold in the shape of the outer surface of the kayak or canoe hull. The mold must include a projection in each position that a support bridge is desired in the coaming of the kayak or canoe. Then a predetermined charge of a plastic powder is placed inside the mold and the mold is placed in a heated oven. The mold is rotated in the oven causing the plastic powder to tumble inside the mold. As the powder becomes hot, it starts to coat the inside surface of the mold. The mold is then cooled while still rotating until the plastic solidifies. The mold is then opened and the kayak or canoe hull including a support bridge in the coaming is removed from the mold. A detailed discussion of support bridges can be found in ROTATIONAL MOULDING OF PLASTICS pp. 14, 15, 132, 133, 140, 141–144,158–161 and 180–181 (R. J. CRAWFORD ed., Research Studies Press Ltd., 1992) and ROTATIONAL MOULDING OF PLASTICS 164–168 (R. J. CRAWFORD ed., Research Studies Press, Ltd., $2^{nd}$ ed. 1996). Additional mold segments resulting in additional parting lines may be needed, as compared to conventional molds. Whereas the coaming of a conventional kayak can be forced past a protruding mold part, the coaming according to the preferred embodiment of this invention has such rigidity that it cannot deform, so that an additional mold segmentation is necessary.

Certain modifications and improvements will occur to those skilled in the art upon a reading of the foregoing description. By way of example, various materials other than polyethylene may be used, as will be apparent by those of ordinary skill. Other openings in a canoe or kayak can have a similar structure, if desired. It should be understood that all such modifications and improvements have been deleted herein for the sake of conciseness and readability but are properly within the scope of the following claims.

I claim:

1. An improved kayak or canoe comprising:

a hull having a bottom and an opening above the bottom; and a coaming integral with the hull and encircling the opening and including an outer wall and an inner wall, the inner wall spaced apart from the outer wall, and at least one integrally molded support bridge extending between the inner wall and the outer wall of the coaming.

2. The kayak or canoe according to claim 1 further including a lip extending outwardly from the opening providing a groove along the outer wall of the coaming for attaching a skirt to the coaming.

3. The kayak or canoe according to claim 1 wherein the hull opening provides access to a cockpit in the kayak or canoe.

4. The kayak or canoe according to claim 1 wherein the opening is a hatch opening.

5. The kayak or canoe according to claim 1 wherein the opening is an inspection port.

6. The kayak or canoe according to claim 1 further including a knee brace inside the hull opening.

7. The kayak or canoe according to claim 1 further including a seat attached to the coaming and located inside the hull.

8. The kayak or canoe according to claim 1 further including at least one additional integrally molded support bridge.

9. The kayak or canoe according to claim 8 wherein the additional support bridge is spaced from about 1 to 12 inches from the first-mentioned support bridge.

10. The kayak or canoe according to claim 1 wherein the inner wall is spaced from the outer wall by between about ¼ to about ¾ inches.

11. A kayak or canoe as claimed in claim 1 wherein the hull is molded and the bridge is formed as a kiss-off.

12. The kayak or canoe according to claim 1 further including a projection along the inner wall of the coaming extending inwardly into the hull opening for attaching a part to the projection.

13. The kayak or canoe according to claim 12 wherein the part is selected from the group including a seat, seat component, knee brace, or backrest.

14. An improved kayak or canoe comprising:

a hull having a bottom and an opening above the bottom; and a coaming integral with the hull and encircling the opening and including an outer wall and an inner wall, the inner wall spaced apart from the outer wall, and at least one support bridge extending between the inner wall and the outer wall of the coaming, further including a projection along the inner wall of the coaming extending inwardly into the hull opening for attaching a knee brace to the projection.

15. The kayak or canoe according to claim 14 further including a plurality of holes in the projection for selectively adjusting the location of the knee brace.

16. The kayak or canoe according to claim 14 wherein the support bridge is adjacent the projection.

17. A method of producing a kayak or canoe hull having a coaming including at least one support bridge comprising:

providing a mold in the shape of the outer surface of the kayak or canoe hull, the mold including an inward projection for forming a support bridge in a coaming encircling an opening in the kayak or canoe hull;

placing a charge of a plastic powder in the mold;

heating the mold;

rotating the mold;

cooling the mold;

opening the mold; and removing the thermoplastic kayak or canoe hull including the coaming having at least one support bridge from the mold.

18. A method according to claim 17 wherein the plastic powder forms a kiss-off during rotating resulting in-the support bridge.

19. A canoe or kayak comprising:

a hull with a cockpit opening and a coaming around the cockpit opening, the coaming including inner and outer walls spaced apart and intermittently joined by a plurality of integrally molded bridges between the spaced apart walls.

20. A canoe or kayak comprising:

a hull with a cockpit opening and a coaming around the cockpit opening, the coaming including inner and outer walls spaced apart and intermittently joined by a plurality of bridges between the spaced apart walls, wherein the hull is rotomolded and the bridges are formed as kiss-offs.

21. An improved kayak or canoe comprising:

a hull having an opening; and a coaming integral with the hull and at least partially bordering the opening and including an outer and inner walls, the inner wall spaced apart from the outer wall, and at least one support bridge integrally molded to and extending between the inner wall and the outer wall of the coaming.

* * * * *